US006092672A

United States Patent [19]

Harris et al.

[11] Patent Number: 6,092,672

[45] **Date of Patent: *Jul. 25, 2000**

[54] DESKTOP MODULAR ASSEMBLY

[75] Inventors: David C. Harris, Baraboo, Wis.; Aimee J. Markelz, Chicago; Charles E. Bain, West Dundee, both of Ill.

[73] Assignee: Berol Corporation, Bellwood, Ill.

[ * ] Notice: This patent is subject to a terminal disclaimer.

[21] Appl. No.: 09/174,950

[22] Filed: Oct. 19, 1998

Related U.S. Application Data

[63] Continuation-in-part of application No. 08/656,161, May 30, 1996, Pat. No. 5,823,359.

[51] Int. Cl.[7] ..... A47F 5/00

[52] U.S. Cl. ..... 211/11; 211/55; 211/126.2; 211/155

[58] Field of Search ..... 211/11, 55, 194, 211/10, 126.2, 126.12, 126.13, 128.1, 126.14; D19/86, 90, 91, 92

[56] References Cited

U.S. PATENT DOCUMENTS

| | | |
|---|---|---|
| D. 270,256 | 8/1983 | Sankey . |
| D. 277,969 | 3/1985 | Bustos . |
| D. 290,852 | 7/1987 | Wang . |
| D. 310,544 | 9/1990 | Evenson . |
| D. 325,222 | 4/1992 | Brussing . |
| D. 330,047 | 10/1992 | Evenson . |
| D. 343,417 | 1/1994 | Tarozzi . |
| D. 349,131 | 7/1994 | Nystrom et al. . |
| D. 359,763 | 6/1995 | Martin . |
| 810,581 | 4/1906 | Swope . |
| 3,515,283 | 6/1970 | Poteat . |
| 3,524,553 | 8/1970 | Zitmore et al. . |
| 4,083,456 | 4/1978 | Genn et al. . |
| 4,162,014 | 7/1979 | Bobrick . |
| 4,353,470 | 10/1982 | Polheurus et al. . |
| 4,871,218 | 10/1989 | Swinson . |
| 4,911,311 | 3/1990 | Nagai . |
| 5,363,974 | 11/1994 | Chan . |
| 5,527,568 | 6/1996 | Boone et al. . |
| 5,575,396 | 11/1996 | Smed . |
| 5,823,359 | 10/1998 | Hanis et al. ..... 211/11 |

OTHER PUBLICATIONS

Selected pages from: Rubbermaid® Office Products 1995 Catalog.

Staples® The Office Superstore 1994/95 Winter Catalog.

Markkelz Office Products 1996 Office Products Catalog.

*Primary Examiner*—Robert W. Gibson, Jr.

*Attorney, Agent, or Firm*—Foley & Lardner

[57] ABSTRACT

A modular desktop assembly is disclosed including a base and a plurality of modules including a vertical file releasably attached to and supported by the base and a cap releasably attached to the last to be stacked module.

16 Claims, 9 Drawing Sheets

DESKTOP MODULAR ASSEMBLY

This application is a continuation-in-part of U.S. patent application Ser. No. 08/656,161 filed May 30, 1996, now U.S. Pat. No. 5,823,359.

DESCRIPTION

1. Field of the Invention

The present invention relates generally to the field of desktop assemblies. More particularly, the invention relates to a modular desktop assembly file assembly supported by a base.

2. Background of the Invention

Desk organizers are a popular office item which allow a user easy access to commonly used office items. Additionally, file trays are commonly used to organize the flow of paper work within an office. For example, desk trays are often utilized both to coordinate the flow of paper as well as to organize files based on various classifications.

Desk trays may be stacked in a multi-tiered manner permitting additional trays to be added as required. This type of desk tray is exemplified in U.S. Design Pat. No. Des. 325,222 entitled MULTI-TIERED DESK TRAY issued Apr. 7, 1992, to Brussing. This type of stacked desk tray requires desk space equivalent to the base tray.

Another type of file organizer is the vertical file holder in which files or papers are supported in a vertical position. The vertical file holders are often desktop units which include a series of compartments located adjacently. This type of file holder is often combined with a desk organizer of some sort as exemplified in U.S. Pat. No. Des. 330,047 entitled COMBINED VERTICAL FILE AND ORGANIZER FOR ASSORTED DESK ACCESSORIES issued Oct. 6, 1992, to Evenson. The Evenson patent discloses a plurality of vertical files located one in front of the other and attached to a desk organizer. This design, however, requires significant desk space since the files are located in series one behind the other. Similarly, U.S. Pat. No. Des. 270,256 entitled DESK ORGANIZER issued Aug. 23, 1983, to Sankey, discloses a series of vertical files located next to one another and attached to a desk organizer. This concept also requires significant desk space.

Files are often attached vertically to a wall in a cascading manner as exemplified in U.S. Pat. No. Des. 349,131 entitled STACKABLE TRAY UNIT FOR WALL MOUNTING issued Jul. 26, 1994, to Nystrom, et al. In this type of arrangement the files are arranged vertically and take up minimal office space. In one arrangement each file is individually attached to the wall. In another arrangement the top file is typically attached to the wall or a partition hanger and the subsequent files are hung from the top file. This type of arrangement is disclosed in U.S. Pat. No. 4,162,014 entitled VERTICAL FILE CONSTRUCTION issued on Jul. 24, 1979, to Bobrick. However, these type of arrangements require a wall or partition.

Accordingly, it would be desirable to have a modular desktop assembly including various modules including a vertical file that could be combined with a desk organizer that did not require the attachment to a wall, partition or construction of a supporting frame.

SUMMARY OF THE INVENTION

A modular desktop assembly in accordance with one aspect of the present invention comprises a base and a module supported by the base. The base includes a support surface, a front and a rear, and an upper attachment region proximate the rear of the base. The module includes a bottom attachment region, and a top attachment region. One of the module bottom attachment region and the base attachment region includes at least one resilient attachment member having an aperture. The other of the module bottom attachment and the base attachment includes at least one tab. The module is attached to and supported by the base by releasable engagement of the at least one tab in the at least one aperture.

In accordance with another aspect of the invention, a modular desktop vertical file assembly comprises a base including a support surface and a base attachment region. The base attachment region includes at least one resilient attachment member having an aperture. The vertical file assembly further includes a plurality of vertical files where each vertical file includes a bottom panel, a rear panel perpendicular to the bottom panel, a pair of side panels and a front panel. The front panel extends from the bottom panel at a non perpendicular angle. Additionally, the rear panel and each side panel include a top attachment region having at least one resilient attachment member including an aperture, and a bottom region including at least one tab.

The plurality of vertical files includes a first vertical file and at least one subsequent file, the first vertical file is attached to and supported by releasable engagement of the tabs of the first vertical file in the plurality of apertures in the top attachment portion of the base. The tabs of the subsequent files are releasably engaged in the plurality of apertures in the top attachment portion of the previous vertical file.

BRIEF DESCRIPTION OF THE DRAWINGS

These and other features of the invention will be more fully understood by reference to the following description and the appended FIGURES, wherein like reference numerals designate like elements and in which.

DETAILED DESCRIPTION OF THE PREFERRED EMBODIMENTS

Figure 1:
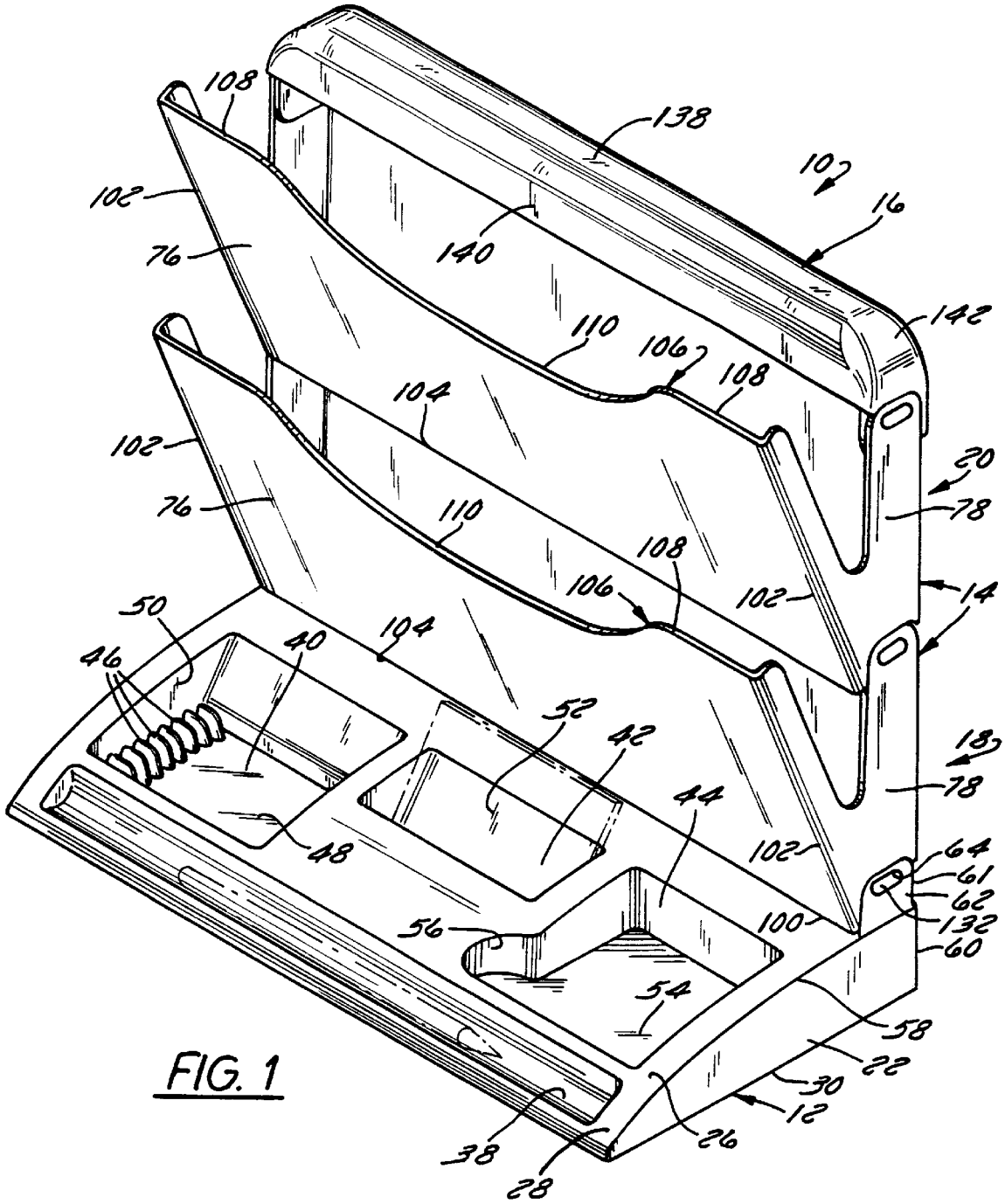
FIG. 1 is a front perspective view of the modular vertical file assembly in accordance with the present invention.
Figure 2:
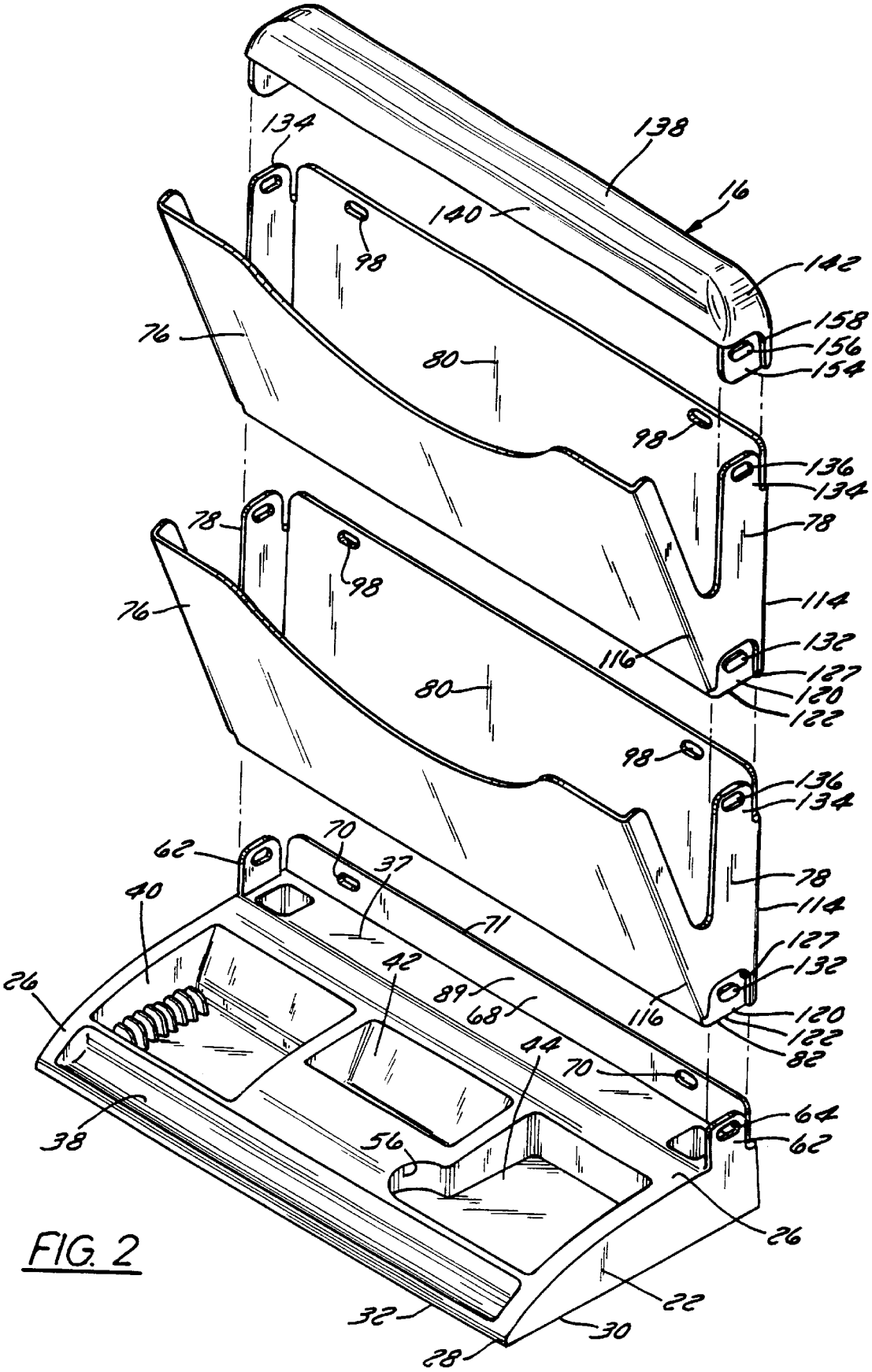
FIG. 2 is an exploded front perspective view of the base, vertical files and cap of the vertical file assembly of FIG. 1.
Figure 3:
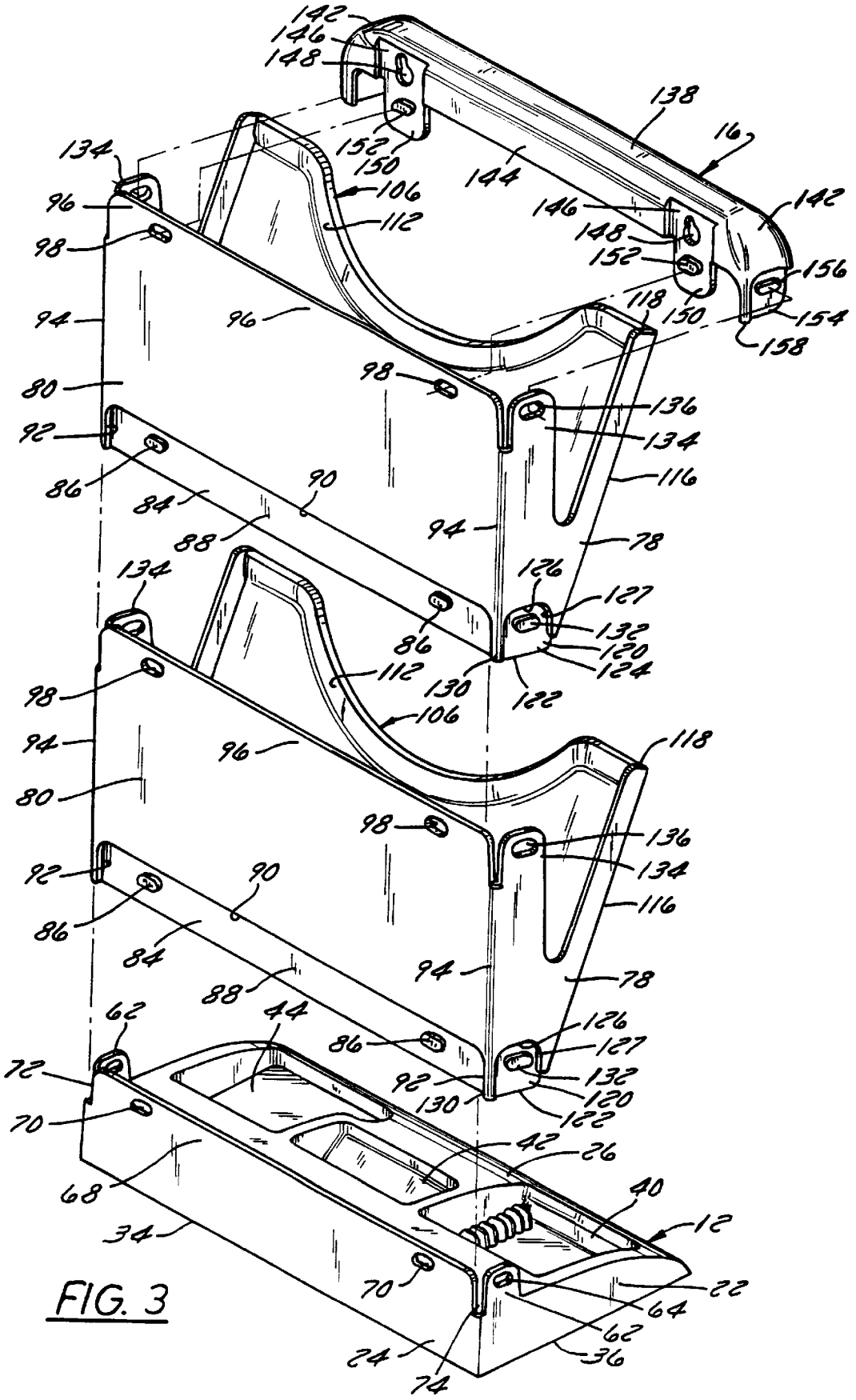
FIG. 3 is an exploded rear perspective view of the base, vertical files and cap of the vertical file assembly of FIG. 1.
Figure 5:
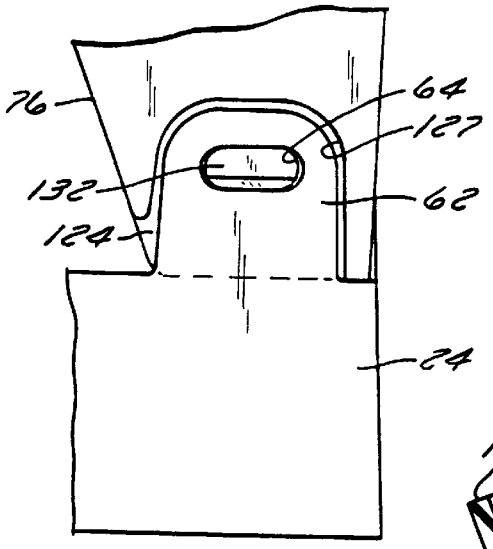
FIG. 5 is a fragmentary side view generally along line 5—5 of FIG. 1.

Turning now to the drawings and referring first to FIG. 1, a file assembly 10 comprises a base 12, a plurality of vertical files 14 and a cap 16. Vertical files 14 include a first vertical file 18 releasably attached to and supported by base 12 and a subsequent vertical file 20 releasably attached to and supported by first vertical file 18. Although not shown, additional vertical files may be attached as will be described in greater detail below. Cap 16 is attached to the last to be supported vertical file.

Figure 9:
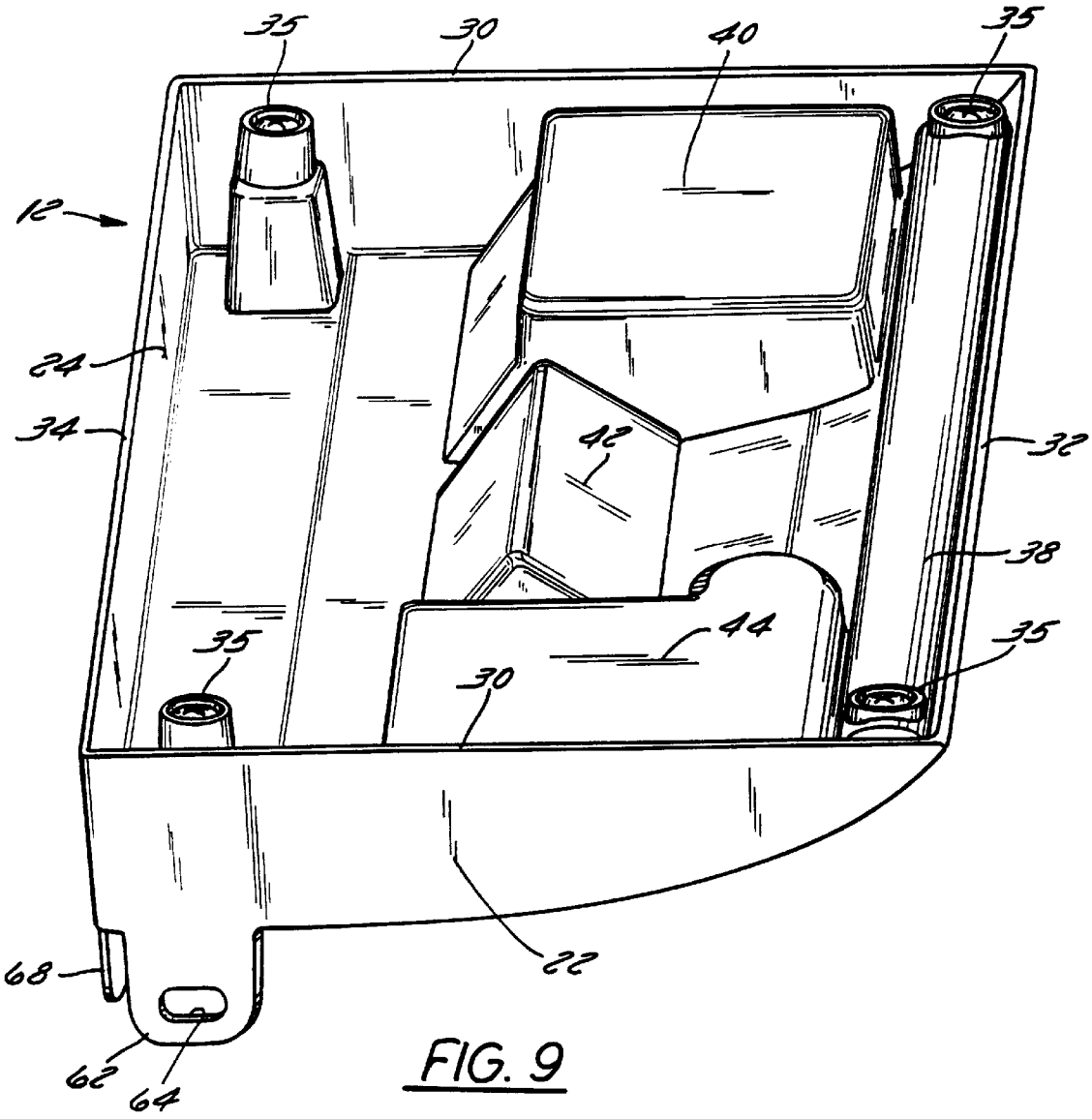
FIG. 9 is a perspective view of the bottom of the base of the vertical file of FIG. 1.

Base 12 includes a pair of side walls 22, a back wall 24 and a top panel 26. Top panel 26 has a curvilinear profile such that a front portion 28 of top panel 26 slopes downward. Each side wall 22 includes a bottom edge 30. Similarly, back wall 24 and front portion 28 of top panel 26 include bottom edges 34, 32 respectively. Base 12 further includes four feet 35 which extend beyond bottom edges 30, 32 and 34 (See FIG. 9). Feet 35 define a bottom support surface 36. Top panel 26 further includes a support region 37 which is substantially parallel to bottom support surface 36.

In the preferred embodiment, base 12 further includes a number of desk organizer features such as a writing implement well 38, a disk support section 40, a business card well 42 and a pad well 44. Writing implement well 38 extends longitudinally intermediate side walls 22 proximate front portion 28 of base 12.

Figure 4:
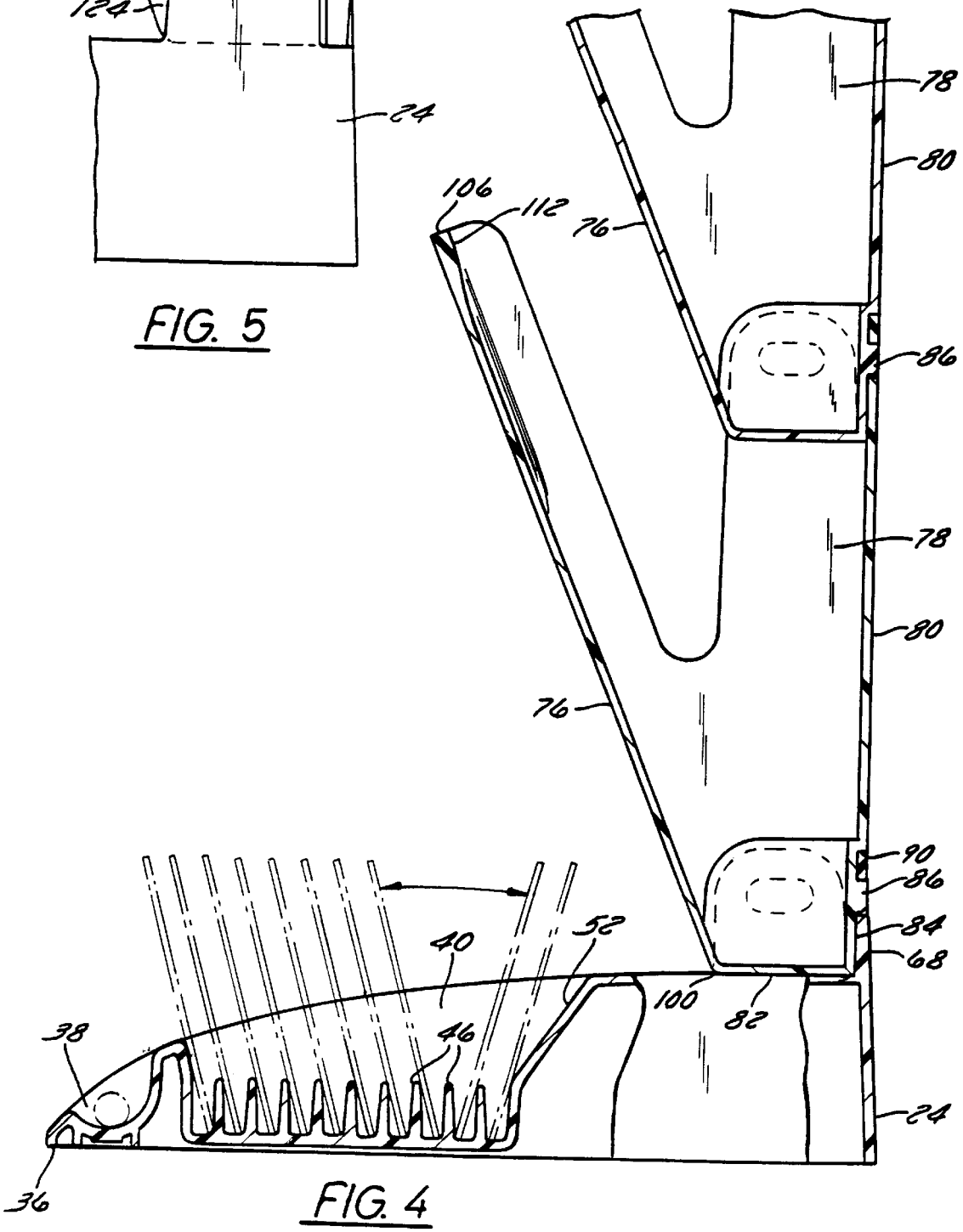
FIG. 4 is a side sectional view generally along line 4—4 of FIG. 1.

Writing implement well 38 has a semi-circular cross-section for supporting various writing implements, one of which is shown in dashed lines in FIGS. 1 and 4. However, other cross-sections of writing implement well 38 may be used, for example, a rectangular or other curvilinear form.

Disk support section 40 includes a plurality of separators 46 arranged in parallel and extending from a base surface 48 of writing implement well 38. In the preferred embodiment each separator 46 includes two portions each of which is located adjacent a side wall 50 of disk support section 40. However, separators 46 may be a single member extending intermediate side walls 50 of disk support section 40. Separators 46 are situated a distance from one another to permit the insertion of a three and one-half inch computer diskette which is shown in dashed lines in FIG. 4. Additionally, the distance between the separators 46 permit the individual rotation of each computer disk to allow a user to view an identifying label located on the front portion of each disk as each disk is rotated from a forward leaning position to a rearward leaning position as illustrated in FIG. 4.

Business card well 42 is centrally located between sidewalls 22 of base 12 between disk support section 40 and pad well 44. Business card well 42 has an angled rear wall 52 such that business cards shown in dashed lines in FIG. 1 are supported at an angle that facilitates viewing of the cards by the user.

Pad well 44 includes a bottom surface 54 for supporting a pad such as a Post-it™ type note pad. Pad well 44 further includes a finger well 56 having a radial shape to permit the insertion of a user's finger to gain easy access to a note pad located within pad well 44.

Each sidewall 22 of base 12 has a top edge 58 having a profile which matches that of top panel 26. Each sidewall 22 further includes a rear edge 60 which is substantially perpendicular to bottom edge 30.

Each sidewall 22 also includes a resilient extension portion 62 extending from top edge 58 proximate rear edge 60. Extension portion 62 includes an aperture or slot 64 located proximate a top edge of extension portion 62. Extension portion 62 further includes a rear edge 61 which does not extend to the rear edge 60 of sidewall 22. Rather, rear edge 61 of extension portion 62 is located a set distance from rear edge 60.

Back wall 24 of base 12 includes a back extension portion 68 which extends a given distance above top surface support region 37. Back extension portion 68 includes two slots 70 situated proximate a top edge 71 of back extension portion 68. Each slot 70 is located a set distance from a side edge 72 of back extension portion 68. Similar to slots 64 of side extension portion 62, the slots 70 have a longitudinal axis that is parallel with bottom edge 34 of back wall 24. In the preferred embodiment, side edges 72 of back extension portion 68 are located a set distance from side edge of back wall 24. In this manner a corner opening 74 is formed between sidewall extension portion 62 and back wall extension portion 68. The specific utility of this corner opening will be described below.

Vertical files 14 are identical in all aspects to one another. Vertical files 14 are identified as first vertical file 18 and subsequent vertical file 20 to aid in the description below of the construction of vertical file assembly 10. As illustrated in FIGS. 1–4, each vertical file 14 includes a front panel 76, a pair of side panels 78, a rear panel 80 and a bottom panel 82 (see FIG. 4).

Rear panel 80 is attached to and extends perpendicular from bottom panel 82. Rear panel 80 includes a recessed region 84 located proximate bottom panel 82 and extending intermediate side panels 78. Recessed region 84 has a depth equal to the thickness of extension portion 68 of back panel 24 of base 12. Recessed region 84 includes a pair of tabs 86 which are located a set distance from bottom panel 82 and located a set distance from side panel 78. Recessed region 84 further includes a recessed surface 88, a top edge 90 and side edges 92. Each side edge 92 of recessed region 88 is located a set distance from side edge 94 of rear panel 80. Each tab 86 extends a distance from recessed surface 88 substantially equal to the thickness of back panel extension 68 of base 12.

Rear panel 80 further includes a resilient top extension region 96 distal recessed region 88. Top extension region 96 is identical to back extension region 68 of base 12. Specifically, top extension region 96 includes two slots 98 located a set distance from side edge 94 of rear panel 80. Slots 98 have a longitudinal axis that is parallel with the longitudinal axis of tabs 86 of the recessed region.

In the preferred embodiment, front panel 76 extends outward from a front edge 100 of bottom panel 82 at an angle from the perpendicular. Front panel includes a pair of side edges 102, a bottom edge 104 and a top edge 106. Top edge 106 includes a first region 108 parallel to bottom edge 104 and a second region 110 having a curvilinear profile extending below first region 108. Top edge 106 includes a reenforced area 112 having an increased material thickness proximate top edge 106 for greater strength and integrity of front panel 76. As illustrated in FIG. 4, top edge 106 of front panel 76 is located a greater distance from bottom panel 82 than the top edge of rear panel 80.

Each side panel 78 has a rear edge 114 attached to rear panel 80 and a front edge 116 attached to front panel 76. Each side panel 78 further includes a V-shaped opening extending from a top edge 118 of side panel 78. Similar to rear panel 80, side panel 78 includes a recessed region 120 located proximate a bottom edge 122 of side panel 78. Recessed region 120 includes a recessed surface 124, a top edge 126 and side edges 127. Each side edge 127 of recessed region 120 is located a set distance from rear edge of side panel. In this manner, a corner post 130 is formed. Recessed region 120 includes a tab 132 which extends a distance from recessed surface 124 substantially equal to the thickness of side extension panel 62 of base 12.

Also similar to rear panel 80, side panel 78 includes a resilient top extension region 134 distal recessed region 120. Specifically, top extension region 134 includes a slot 136 having a longitudinal axis that is parallel with the longitudinal axis of tab 132 of recessed region 120.

Cap 16 includes a top region 138, a front region 140, a pair of side regions 142 and a rear region 144. In the preferred embodiment, top region 138 is substantially parallel to bottom surface 36 of base 12. However, other profiles may be used such as a curvilinear profile. Front and rear regions 140, 144 radially extend from and are substantially perpendicular to top region 138. Rear region 144 includes a pair of recessed regions 146 each located a set distance from side region 142. Recessed regions 146 include a key slot 148 located proximate top region 138. Key slot 148 permits the unit to be attached to a wall or partition in the usual manner. Rear region 144 further includes an extension portion 150. Each extension portion includes a tab 152 having a longitudinal axis parallel to top region 138. Recessed region 146 is set back a distance equal to the thickness of extension 96 of rear panel 80. Each tab 152 extends a distance from recessed region 146 substantially equal to the thickness of top extension 96 of rear panel 80.

Side region 142 of cap 16 includes a recessed region 154 having a tab 156. Tab 156 has a longitudinal axis substantially parallel to top region 138 of cap 16. A corner post 158 is formed at the intersection of side region 142 and rear region 144 (see FIG. 3).

The construction of the modular vertical file assembly 10 will now be described in greater detail. First vertical file 18 is releasably attached to base 12 by insertion of tabs 132, 86 located in the recessed regions of the vertical file side panels and rear panel into slots 64, 70 of extension portions 62, 68 of the side panel and back panel of base 12. In this manner, bottom panel 82 of vertical file 14 is in contact with support region 37 of base 12.

Additionally, corner post 130 of vertical file 14 is received within corner openings 74 of base 12. In this engaged position, extension portions 62, 68 are located within recessed regions 120 and 84. In this manner, rear panel 80 of vertical file 14 is flush with back panel 24 of base 12. Similarly, side panel 22 of base 12 is flush with side panel 78 of file 14.

In a similar manner, subsequent vertical file 20 is supported by first vertical file 18. Tabs 132, 86 of subsequent file 20 are inserted into slots 136, 98 of extension portions 134, 96 of side panels 78 and rear panel 80 respectively. Additional vertical files 14 may be stacked in a similar manner.

Figure 7:
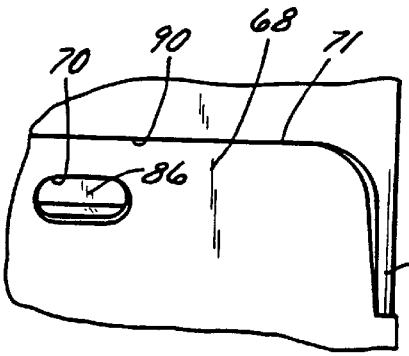
FIG. 7 is a rear view of the cap and vertical file tab and aperture generally along line 7—7 of FIG. 6.
Figure 6:
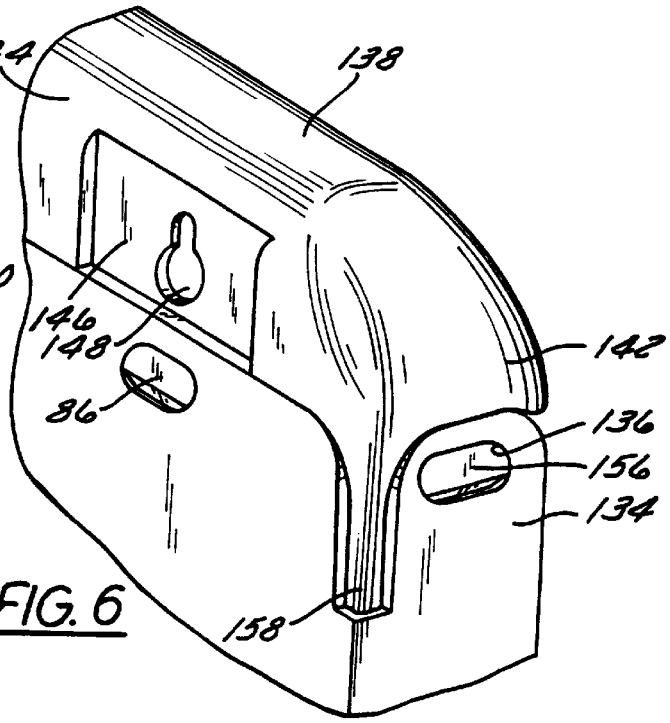
FIG. 6 is a fragmentary perspective view of the cap and vertical file of FIG. 1.
Figure 8:
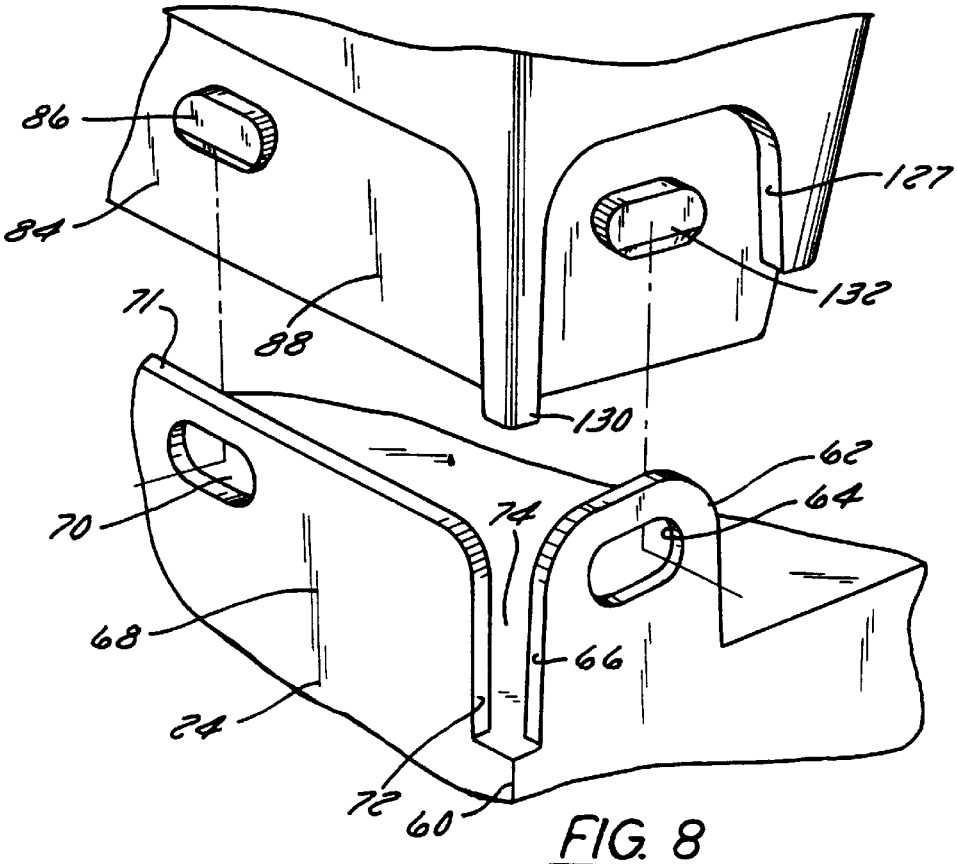
FIG. 8 is an exploded rear perspective view of an attachment region of the base and vertical file.

As illustrated in FIGS. 6–8 tabs 132, 86 are beveled to aid in the entry of slots 64, 70. As the vertical files are attached first to the base and then to one another, tabs 132, 86 force resilient extension portions 134, 96 outward until tabs 132, 86 begin to enter slots 64, 70 at which point the extension portions spring back into place.

By design, tabs 86 of rear panel 80 are located higher than tabs 86 of side panels 78. However, slots 70 and 64 of base 12 are the same distance from vertical surface 36, similarly, slots 98 and 136 of vertical files 14 are located the same distance from bottom panel 82. In this manner the top surface of rear tabs 86 will be biased toward the top surface of slots 70 in base 12 and slots 98. This design results in the clearance between the tabs and the upper surface of the slot being minimized. When vertical files 14 are placed into the cavity defined by the area between front panel 76 and rear panel 80 a force will be imparted on front panel 76, thereby causing a moment about the attachment surfaces between vertical file 14 and base 12. The minimal clearance between tabs 86 and slots 70 will aid to counteract the tendency for vertical file 14 to lean forward. This will further help to maintain the vertical orientation of vertical file 14 with respect to base 12.

As described above bottom panel 82 is in contact with support surface 37 of base 12. However, in an alternative embodiment in an attempt to minimize the effects of manufacturing variability, bottom panel 82 of vertical file 14 does not come into contact with support surface 37 of base 12. Rather, by design, tabs 132 of side panel 78 of vertical file 14 rest on the bottom surface of slots 64 on side extension of base 12. The moment discussed above is counteracted by maintaining the bias of tabs 86 of rear panel 80 with respect to slots 70 of back extension portion 68.

However, in the preferred embodiment the support of subsequent vertical file 20 is supported by first vertical file 18 as described immediately above. Specifically, tabs 132 of side panel 78 of subsequent vertical file 20 rest on the bottom surface of slots 136 on top extension region 134 of first file 18, while the top surface of tabs 86 of rear panel 80 of subsequent file 20 abut the top surface of slots 98 on first file 18. The moment discussed above is counteracted by maintaining the bias of tabs 86 of rear panel 80 with respect to slots 98 of back extension portion 96.

The only limitation of the number of vertical files which may be stacked in this manner is a function of the strength of the material used and the size of the base.

A cap 16 is attached to the last-to-be-stacked vertical file to complete modular vertical file assembly 10. Similar to the attachment of the components listed above, tabs 156, 152 of side region 142 and rear region 144 of cap 16 are releasable engaged within slots 136, 98 of extension portion 134 of side panel 78 and extension portion 96 of rear panel 80 respectively.

Although, not shown, recessed regions 120, 84 include a groove to permit the insertion of a screw driver or similar type device to aid in the release of tabs 132, 86 from slots 70, 64 in base 12 and slots 98, 136 in vertical files 14.

In the preferred embodiment of the completed vertical file assembly 10, rear walls 80 of vertical files 14 are co-planar. That is the rear walls 80 of first vertical file 16 and subsequent vertical file 18 lie in the same plane. Additionally, rear walls 80 are co-planar with back wall 24 of base 12. In the preferred embodiment, vertical files 14 are attached to base 12 proximate rear wall 24 of base 12.

Figure 10:
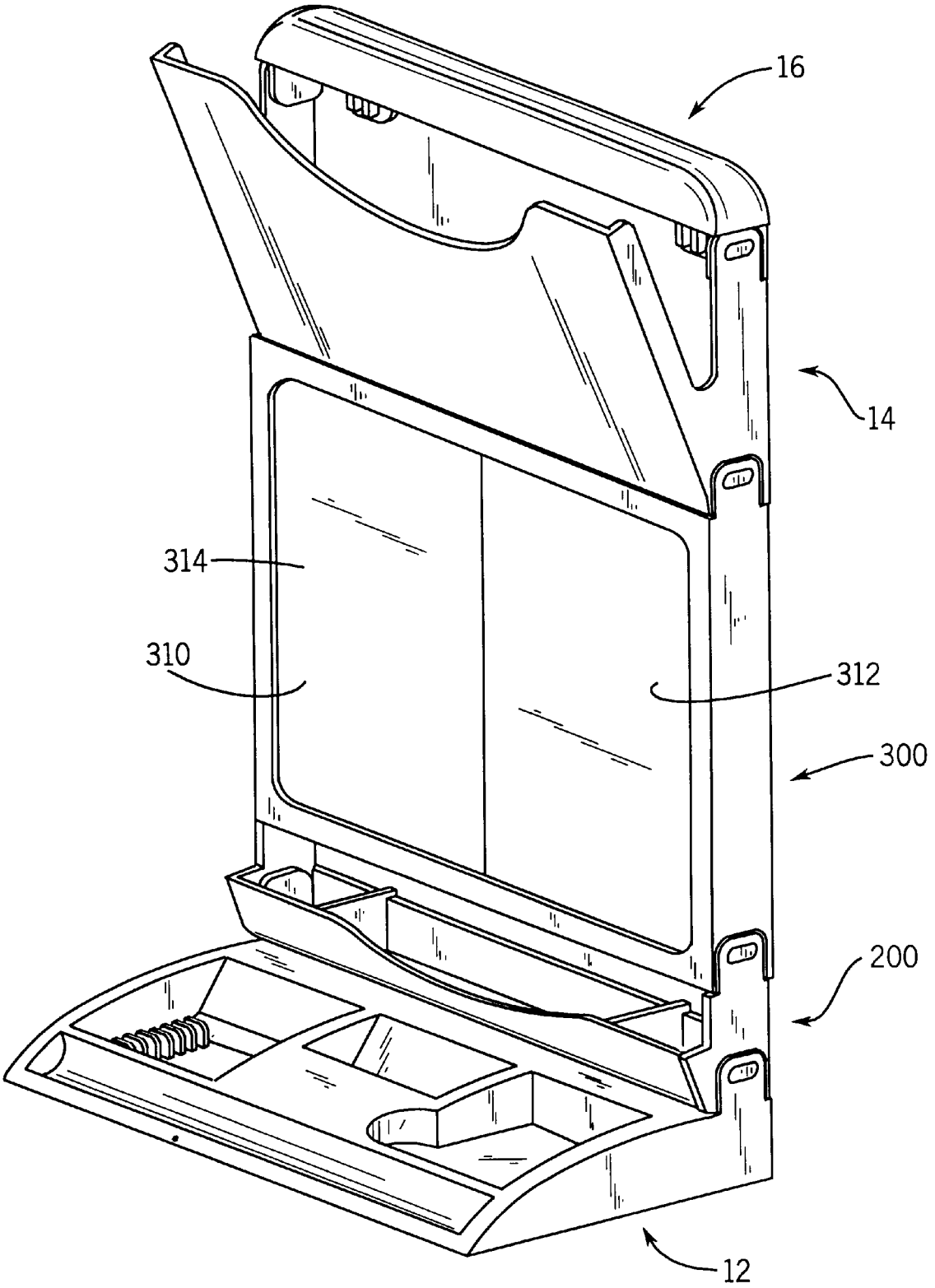
FIG. 10 is a perspective view of a desktop assembly including a vertical file, a bin module and a dry/erase-cork board module.
Figure 11:
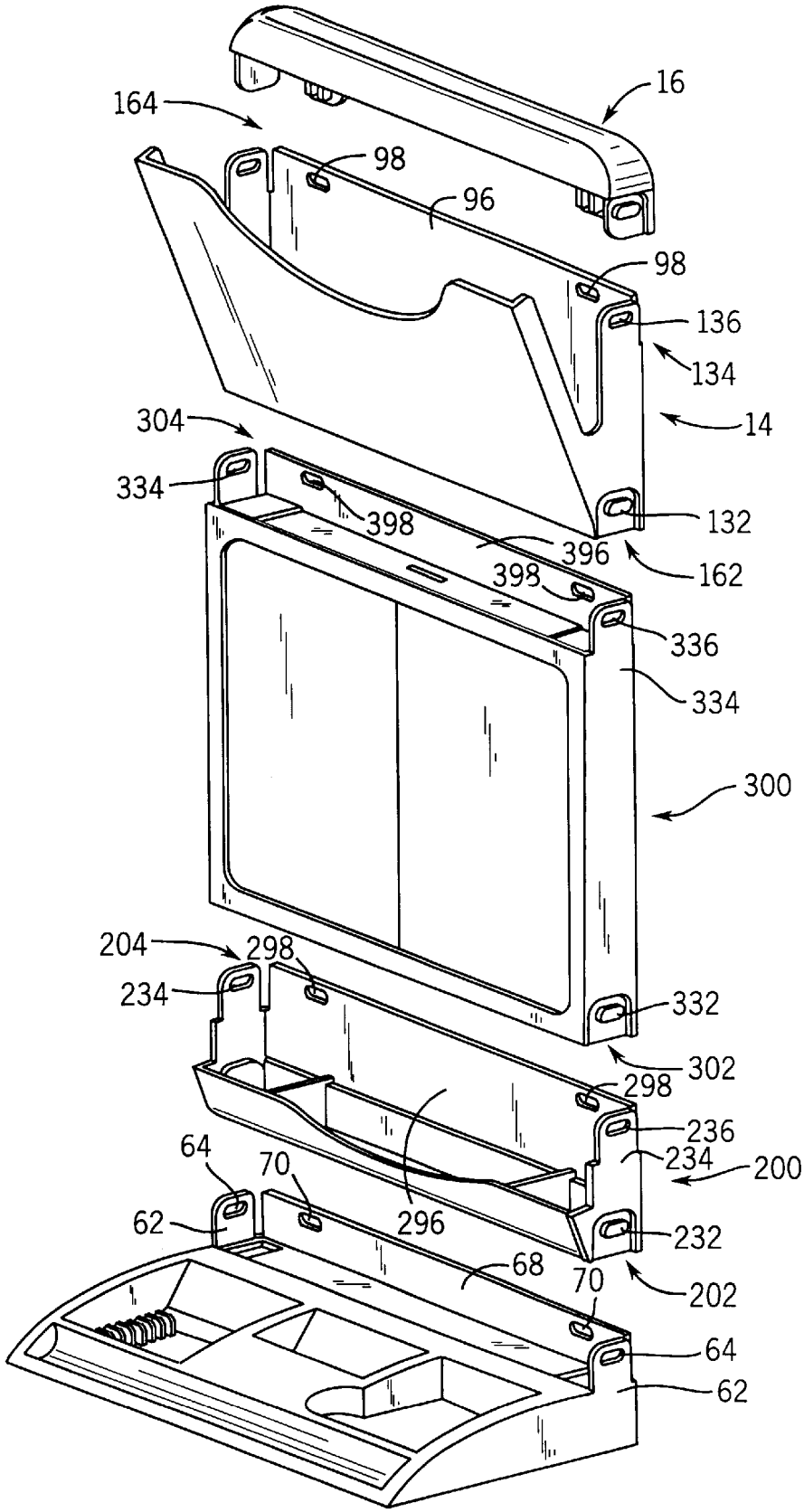
FIG. 11 is an exploded perspective view of the desktop assembly of FIG. 10.
Figure 12:
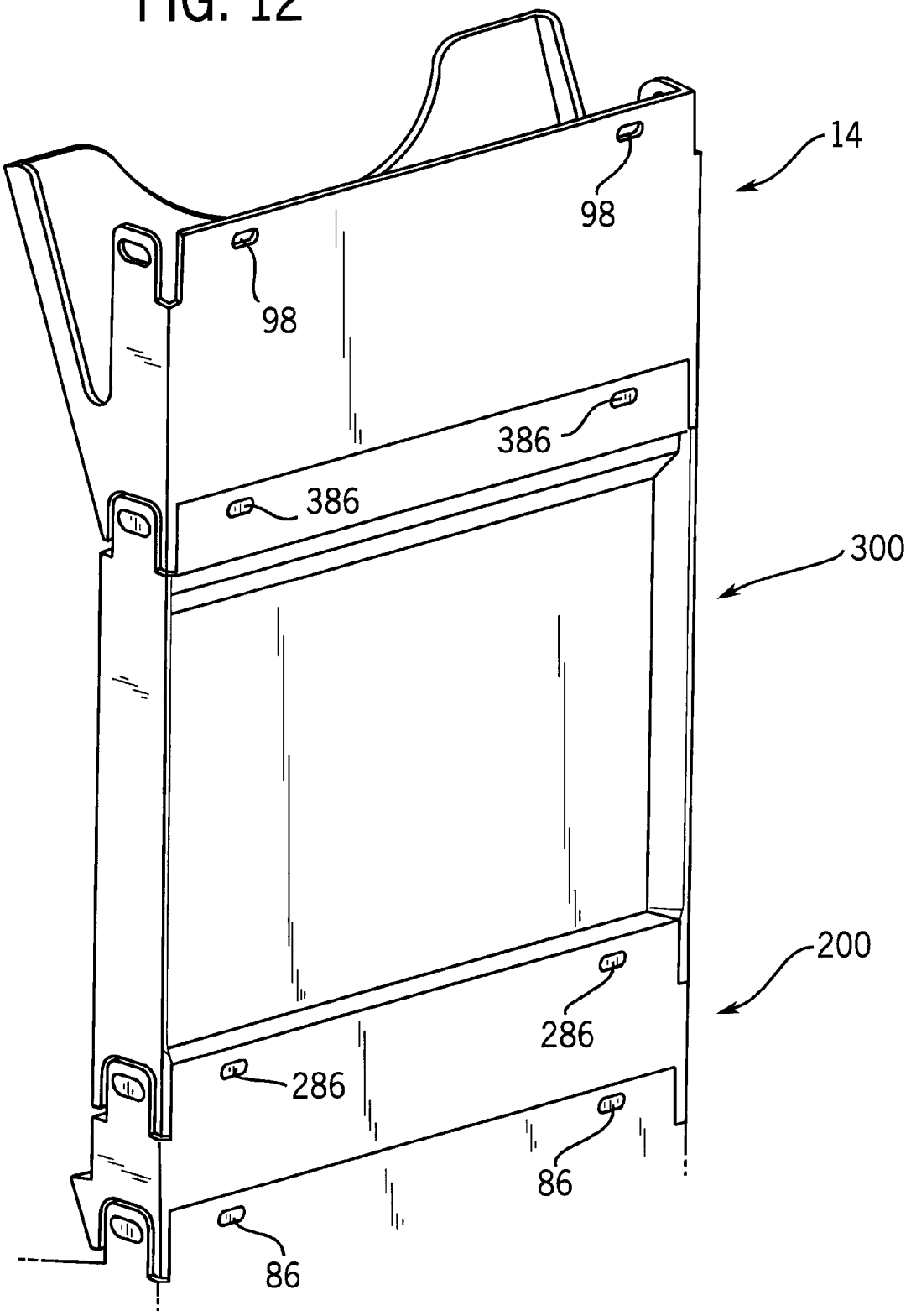
FIG. 12 is a partial rear perspective view of the desktop assembly of FIG. 10.

Vertical files 14 may be substituted with other configurations, such as a rectangular file, a plurality of file pockets attached to each vertical file, or a plurality of shelves. As illustrated in FIGS. 10–12 a dry/erase-cork board module 200 and/or a bin module 300; may be employed in conjunction with a vertical file 14. The dry/erase module includes a front working portion 310 having a dry/erase portion 312 and a cork board portion 314. As illustrated in FIG. 10 the working portion 310 of the dry/erase module is located in the rear portion of the desktop assembly. Additionally, a vertical file 14 may be used in conjunction with the dry/erase module as shown.

Since each module includes the same attachment mechanism, it is possible to mix the modules in any order. For example, it is possible to place the dry/erase-cork board module above the vertical file. It is also possible to employ just the dry/erase-cork board module with the base.

Each module, 14, 200, and 300 include a similar bottom attachment region 162, 202, 302, and an upper or top attachment region 164, 204, 304 respectively. Bottom attachment region 162 of file 14 includes tabs 132, 86 located in recessed regions 120, 84 respectively. Upper attachment region 164 of file 14 includes extension regions 134, 96 having slots 136, 98 respectively.

In a similar manner, bottom attachment regions 202, 302 of modules 200 and 300 include tabs 232, 286 and 332, 386 respectively. Further, upper attachment region 204 of the bin module includes extension portions 234, 296 having slots 236 and 298 respectively and upper attachment region 304 of the dry/erase-cork board module includes extension portions 334, 396 having slots 336 and 398 respectively.

It should be further noted that the base attachment region is similar to the upper attachment region 164, 204, and 304. In this manner the modules 14, 200, and 300 can be interchangeable arranged with the base 12.

Each extension portion 96, 296, and 396 are co-planar with each other as well as with extension wall 68 of base 12. Extension members 62 and 68 and corresponding apertures 64, 70 form the base attachment region or upper attachment region of the base 12 that is similar to the upper attachment regions 164, 204 and 304.

This modular system allows for individual modules to be stacked one on top of the other in a back region of base 12. This permits the unit to be located on a desk proximate a wall surface, with all of the modules being proximate the wall. In contrast, if the modules were cascaded a much greater surface area of the desk would be used.

It will be understood that the foregoing description is of preferred exemplary embodiments of this invention and that the invention is not limited to the specific forms shown. For example various types of desk organizer features may be incorporated into base 12. Alternatively, base 12 may have a solid top panel having no desk organizer features. Additionally, the tabs may have various shapes and/or configurations. Further, the locations of the tabs and slots may be reversed. Also, other types of releasable fasteners may be employed to attach and support vertical files 14 by base 12. These and other modifications may be made in the design and arrangement of the elements without departing from the scope of the invention as expressed in the appended claims.

We claim:

1. A modular desktop assembly comprising:

a base including a support surface, a front and a rear, the base further including an upper attachment region proximate the rear of the base;

a module including a bottom attachment region, and a top attachment region, one of the module bottom attachment region and the base attachment region including at least one resilient attachment member having an aperture, the other of the module bottom attachment and the base attachment including at least one tab; and wherein the module is attached to and supported by the base by releasable engagement of the at least one tab in the at least one aperture.

2. The assembly of claim 1 further including a plurality of subsequent modules, each module having an identical bottom attachment region and upper attachment region, each of the modules being releasably engaged in the plurality of apertures in the top attachment region of the previous supported module.

3. The assembly of claim 2 further including a cap having an attachment portion releasably engaged in the top attachment portion of the last of the plurality of stacked modules.

4. The assembly of claim 2 wherein the base includes a rear wall, and the base attachment region includes a recessed region to receive the bottom attachment region of the adjacent module, each module including a rear panel portion, such that the rear panel of the adjacent module and the rear panel portion of each module are flush.

5. The assembly of claim 2 wherein each module includes a rear extension portion, the rear extension portions being co-planar with the rear wall of the base.

6. The assembly of claim 2 wherein the base attachment region includes includes at least one resilient attachment member having an aperture, and the module bottom attachment region includes at least one tab.

7. The assembly of claim 1 wherein the module includes a dry/erase board portion.

8. The assembly of claim 7 wherein the module includes a cork board portion.

9. A modular desktop assembly comprising:

a base including a rear wall, and a base attachment region proximate the rear wall, the base attachment region including at least one aperture;

two modules, each module having a rear panel and at least one bottom tab and at least one top aperture; and wherein the first module of the two modules is attached to the base by releasable engagement of the at least one bottom tab in the at least one aperture of the base attachment region, the at least one bottom tab of the second vertical file of the two modules is attached to the top aperture of the first module such that the rear panels of the first and second modules are co-planer with the rear wall of the base panel.

10. The assembly of claim 9 wherein one of the modules includes a dry/erase board portion.

11. The assembly of claim 9 wherein one of the modules includes a vertical file.

12. The assembly of claim 11 wherein one of the modules includes a dry/erase board portion.

13. A modular desktop vertical file assembly comprising:

a base including a rear wall, and a base attachment region proximate the rear wall, the base attachment region including at least one aperture;

two vertical files, each vertical file having a rear panel and at least one bottom tab and at least one top aperture; and wherein the first vertical file of the two vertical files is attached to the base by releasable engagement of the at least one bottom tab in the at least one aperture of the base attachment region, the at least one bottom tab of the second vertical file of the two vertical files is attached to the top aperture of the first vertical file such that the rear panels of the first and second vertical files are co-planer with the rear wall of the base panel.

14. The assembly of claim 13 further including a plurality of additional vertical files, each rear wall of each additional vertical being co-planar with the previously stacked vertical files.

15. The assembly of claim 14 further including a cap having an attachment portion releasably engaged in the top attachment portion of the last of the plurality of stacked vertical files.

16. A modular desktop assembly comprising:

a base including a rear wall, and a base attachment region proximate the rear wall;

two modules, each module having a rear panel being co-planer with the rear wall of the base, the first of the modules being releasably attached to the base proximate the rear wall, the second the modules being releasably attached to the first module, wherein at least one of the modules is a vertical file for support of paper, the vertical file having a first panel and a second panel being at an acute angle with respect to the first panel, the first and second panels defining a pocket for supporting paper at the acute angle.

* * * * *